United States Patent [19]

Wu

[11] Patent Number: 4,779,911

[45] Date of Patent: Oct. 25, 1988

[54] PADLOCK SEAL

[76] Inventor: Brown W. Wu, 802-A, 8F., No.90, Chung Hua Rd., Sec.1, Taipei, Taiwan

[21] Appl. No.: 21,449

[22] Filed: Mar. 4, 1987

[51] Int. Cl.[4] ..... B65D 33/34

[52] U.S. Cl. ..... 292/318

[58] Field of Search ..... 292/307 R, 318, 319, 292/322; 70/25

[56] References Cited

U.S. PATENT DOCUMENTS

| | | | |
|---|---|---|---|
| 1,048,837 | 12/1912 | Jessup | 292/318 |
| 1,173,603 | 2/1916 | Murray et al. | 292/318 |
| 1,549,742 | 8/1925 | Brune, Sr. | 292/320 |
| 1,580,573 | 4/1926 | Schara | 70/25 |
| 2,103,743 | 12/1937 | Doty | 292/327 |
| 3,591,223 | 7/1971 | de Lima Castro Nato | 292/320 |
| 4,075,742 | 2/1978 | Remark et al. | 292/307 R X |

*Primary Examiner*—Richard E. Moore
*Attorney, Agent, or Firm*—Darby & Darby

[57] ABSTRACT

A padlock seal comprising a housing, a rod shackle, a U-shaped spring receiver, a constraint nut and a casing, is characterized in: U-shaped spring receiver as well as constraint nut is, respectively, retained in a pocket formed in said housing; each pocket can be divided into two portions of different diameter; said rod shackle is formed with a relatively long leg having a threaded extremity and a relatively short leg having a taper extremity and a circular notch adjacent the taper extremity; said housing is to receive said shackle by means of the U-shaped spring receiver and the constraint nut engaging respectively with the circular notch and the threaded extremity formed on either leg of the shackle, thus close and lock the shackle loop; once it has been locked, it cannot be opened except by so breaking or deforming it as to render it incapable of being re-used.

3 Claims, 2 Drawing Sheets

PADLOCK SEAL

BACKGROUND OF THE INVENTION

This invention relates particularly to seals in which a shackle of loop captured securely within a housing to close and lock the loop. Once the seal has been locked, it cannot be opened except by so breaking or deforming it or to render it incapable of being re-used.

The common seen padlock seals are often constructed by: a lead housing engaged with a soft steel wire, an aluminum sheet engaged with a terminal ball, an iron plate engaged with steel wire hook, and some even engaged with paper sheets.

Owing to their weak structure, it has been found possible to pull the shackle (the soft steel wire, the aluminum sheet and the steel wire hook) from its mate housing (the lead housing, the terminal ball and the iron plate) because when a substantial pull is applied to the shackle, the shackle bent within the housing and lose its locking effectiveness. When a shackle has been pulled from the housing, an interloper may reapply the seal or lock by reshaping and reinserting the ends of the shackle, or he may use a new piece of wire, something quite easily obtained.

SUMMARY OF THE INVENTION

The main object of this invention is to provide a padlock seal which cannot be opened except in such a manner as to render it non-reusable.

Another object of the present invention is to provide a padlock seal with a housing which is preferably of zinc material so as to be adequately non-deformable to serve as a housing, and also with a rod shackle which is preferably of aluminum material. Said rod shackle can be engaged with said housing by means of employing with a resilient U-shaped spring steel receiver and a constraint nut which are retained in the pockets formed in the said housing as to attain the "lock" condition which cannot be opened except using a powerful bolt cutter to rupture the seal thus render it non-reusable.

A more complete understanding of these and other features and advantages of the present invention will become apparent from a careful consideration of the following detailed description of certain embodiment illustrated in the accompanying drawings.

DESCRIPTION OF THE PREFERRED EMBODIMENTS

Figure 2:
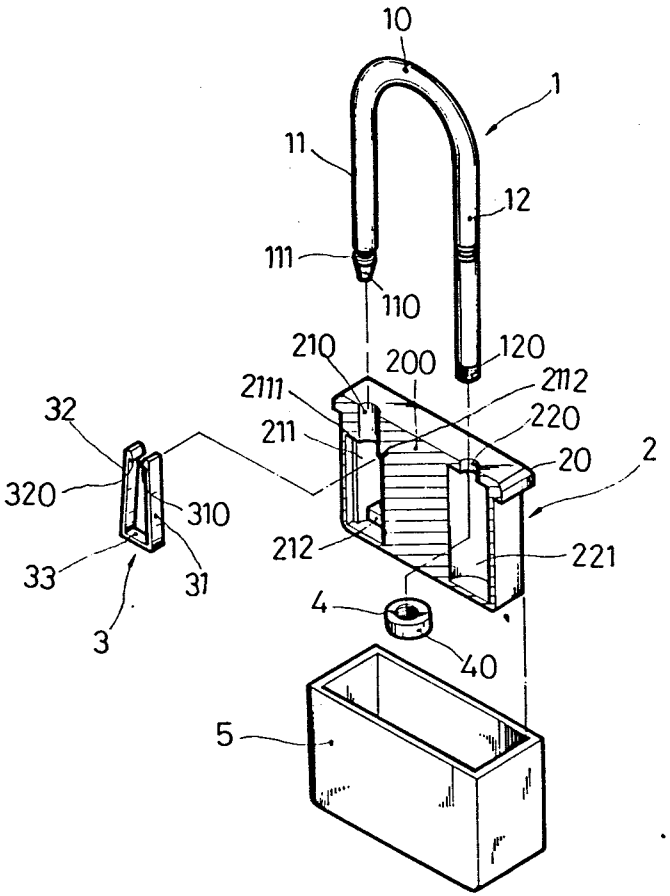
FIG. 2 is a perspective view showing the separated parts of this invention with an exploded housing.
Figure 1:
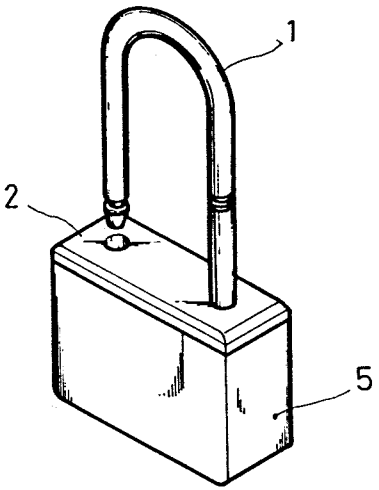
FIG. 1 is a perspective view of the preferred embodiment of this invention in opened condition.
Figure 4:
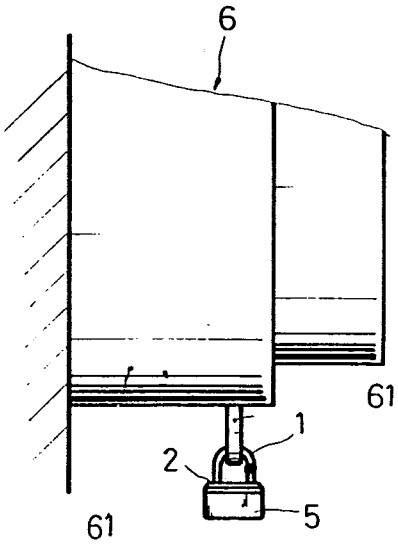
FIG. 4 is a perspective view of this invention as applied to a meter.

The padlock seal illustrated in FIGS. 1 to 4 comprises: a rod shackle 1, a housing 2, a resilient U-shaped spring receiver 3, a constraint nut 4 and a casing 5.

The rod shackle 1 should preferably be of aluminum material, also preferably about 7 mm thick. The housing 2 should preferably be of zinc material which gives it such rigidity as to hold portions of the rod shackle locked therewithin against possible removal therefrom without so damaging the device as to render it non-reusable.

The rod shackle 1 is formed with a relatively short leg 11, a relatively long leg 12 and a loop portion 10 integrally interconnecting the two legs. Said leg 11 is formed with a taper extremity 110 and with a circular notch 111 adjacent the taper extremity 110. Said leg 12 is formed with a threaded extremity 120.

The housing 2, in the form illustrated, is generally rectangular in shape, and is formed with two vertical sliding pocket 21, 22 which are separated by an inner rib 200. The top of the housing is also formed with a lateral flange 20 which is somewhat rounded on its upper surface. Said pocket 21 is formed with a circular upper portion 210, and a circular lower portion 211 with two additional receiving chutes 2111, 2112 extending from either side of the lower portion 211, and there is a rectangular block 212 protruding out from one of the opposite pocket walls. Said pocket 22 is formed with a relatively small upper circular portion 220 and a relatively large lower circular portion 221.

The U-shaped spring receiver 3 is formed with two vertical side walls 31, 32 and a horizontal bottom wall 33 integrally interconnecting the two side walls. Said receiver 3 is preferably of steel material which is suitable for the receiver 3 to possess resilience in the sense of enabling its two vertical side walls 31, 32 to bent toward or away from each other. The receiver 3 also is formed with inwardly extending lateral flanges 310, 320 at the top of each side wall. Said receiver 3 is to be located in the pocket 21, abutting the molding of the housing 2, with its two vertical side walls 31, 32 retained in the two said additional receiving chutes 2111, 2112 respectively and with its wall 31, 32, 33 surrounding the rectangular block 212 on the pocket wall.

The constraint nut 4 is a nut with a circular outer surface 40. Its outer diameter lies between the diameters of the upper circular portion 220 and the lower circular portion 221 of the pocket 22. Said nut 4 is to be retained in the lower circular portion 221 of pocket 22 and is engaged with the threaded extremity 120 of the shackle leg 12, as an incident of the moding of the housing 2.

The casing 5 may be formed of colored PVC material. It is generally rectangular in shape, and its bottom is somewhat rounded. Said casing 5 is to be tightly engaged with the said housing 2 with its top surface receiving the lateral flange 20 of the housing 2. We can have our company name or logo as well as consecutive numbers printed in, not just stamped in, contrasting color letters or numbers that are large and easy to read.

Figure 3B:
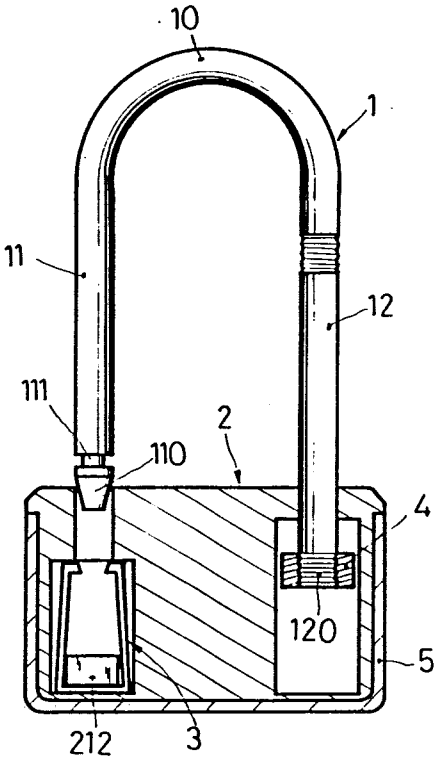
FIG. 3B is a cross-sectional view of this invention in closed condition.
Figure 3A:
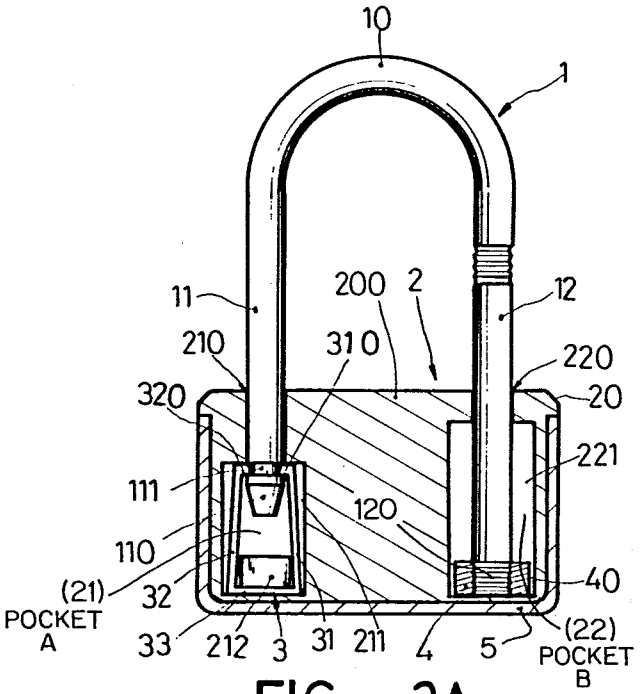
FIG. 3A is a cross-sectional view of this invention in opened condition.

FIG. 3A is the cross-sectional view of this invention in opened condition, wherein the rod shackle 1 is mounted on the housing 2 with the shackle leg 12 inserting into the vertical sliding pocket 22, and with the threaded extremity 120 engaging with the constraint nut 4. The shackle leg 12 can move up and down with the threaded extremity 120 which is now engaged with the constraint nut 4 retained in the lower circular portion 221 of the pocket 22. The shackle leg 11, which now serves as a free end, can locate on the housing 2 with its taper extremity 110 resting on the top of the pocket 21, or it can also lie on any other locations except on the housing 2.

FIG. 3B is a cross-sectional view of this invention in closed condition, wherein the shackle leg 11, at that time, projects into the lower portion 211 of the pocket 21 so that, when the seal is to be applied to some object such as, for example, a hasp assembly 6 on a meter cover 61 (FIG. 4), the taper extremity 110 can be quickly and easily be manually projected into the housing 2 to the condition as shown in FIG. 3B. The shackle leg 11 is then pushed through a hasp eye 62 of the hasp assembly 6, after which the taper extremity 110 is reinserted into the pocket 21. After the seal has been thus applied to the hasp assembly 6, the housing 2 is pushed upwardly in relation to the rod shackle 1 to cause the shackle leg 12 to slide downwardly in pocket 22 and to cause the threaded extremity 120 which is now engaged with nut 40 to seat at the end of pocket 22. During this sliding, said taper extremity 110 of shackle leg 11 can be inserted into the lower portion 211 of the pocket whereafter it lies between the two vertical side walls 31, 32 of the U-shaped spring receiver 3 with the lateral flange 310, 320 projecting into the circular notch 111 on the shackle leg 11, thereby firmly locking the device so that it cannot be opened without using a powerful cutter to cut off the rod shackle 1 thus leaves the evidences of theft of tampering.

It will be clear that the concepts disclosed herein may be put into practice in various other ways without, however, departing from this invention as set forth in the disclosure.

I claim:

1. A padlock seal comprising:

a rod shackle formed with a relatively short leg having a tapered extremity and a circular notch adjacent to the tapered extremity and a relatively long leg having a threaded extremity and a loop portion integrally connecting the two legs;

a housing formed with a top portion having lateral flanges on each side and an inner portion having a first and second vertical sliding pocket, the first sliding pocket being formed with a circular upper portion and a circular lower portion having two chutes for receiving the short leg of the rod shackle, the chutes extending from either side of the circular portion and a rectangular block protruding from one of the opposite side walls of the first pocket, the second sliding pocket which anchors the relatively long leg to the housing being formed with a relatively large circular lower portion and a relatively small circular upper portion;

a u-shaped receiver abutting against the lower portion of the first pocket, the receiver being formed with two vertical sidewalls, a horizontal bottom wall integrally interconnecting the two sidewalls and a rectangular block located between the sidewalls and resting on the horizontal bottom wall, the receiver having inwardly extending lateral flanges at the top of each sidewall, the sidewalls being retained in the two receiving chutes;

a constraint nut having a circular outer surface, the outer diameter of the nut lying between the diameters of the circular upper portion and the circular lower portion of the second pocket, the inner portion of the nut being engaged with the threaded extremity of the relatively long leg, abutting the molding of the housing;

a casing tightly engaged with the housing, the top surface of the casing receiving the lateral flange of the housing and the casing comprising a deformable material.

2. A padlock seal comprising:

a rod shackle formed with a relatively short leg and a relatively long leg, the relatively long leg having a threaded extremity;

a housing having two pockets, a first pocket for receiving the relatively short leg of the rod shackle and second pocket for anchoring the relatively long leg of the rod shackle to the housing;

a u-shaped receiver in said first pocket having two vertical sidewalls, a horizontal bottom wall and a rectangular block located between the sidewalls and resting on the bottom wall, and the receiver comprising a resilient material;

a constraint nut contained within the anchoring pocket, the inner portion of the nut being engaged with the threaded portion of the relatively long leg.

3. The padlock seal defined by claim 2 wherein the housing is surrounded by a casing comprising a deformable material.

* * * * *